US009993022B2

(12) United States Patent
Fritzsching

(10) Patent No.: US 9,993,022 B2
(45) Date of Patent: Jun. 12, 2018

(54) SMOKING PRODUCT WRAPPING MATERIAL HAVING IMPROVED SMOULDERING PROPERTIES

(71) Applicant: GLATZ FEINPAPIERE JULIUS GLATZ GMBH, Neidenfels (DE)

(72) Inventor: Thomas Fritzsching, Neidenfels (DE)

(73) Assignee: GLATZ FEINPAPIERE JULIUS GLATZ GMBH, Neidenfels (DE)

( * ) Notice: Subject to any disclaimer, the term of this patent is extended or adjusted under 35 U.S.C. 154(b) by 0 days. days.

(21) Appl. No.: 14/870,359

(22) Filed: Sep. 30, 2015

(65) Prior Publication Data

US 2016/0015080 A1 Jan. 21, 2016

Related U.S. Application Data

(60) Division of application No. 13/079,617, filed on Apr. 4, 2011, now Pat. No. 9,161,569, which is a continuation of application No. 12/083,314, filed as application No. PCT/EP2005/055198 on Oct. 12, 2005.

(51) Int. Cl.

| | |
|---|---|
| ***A24D 1/02*** | (2006.01) |
| ***D21H 11/00*** | (2006.01) |
| ***B41F 9/00*** | (2006.01) |

(52) U.S. Cl.

CPC ..... *A24D 1/025* (2013.01); *B41F 9/00* (2013.01)

(58) Field of Classification Search

None

See application file for complete search history.

(56) References Cited

U.S. PATENT DOCUMENTS

| | | | | |
|---|---|---|---|---|
| 4,044,778 | A | 8/1977 | Cohn | |
| 2002/0129824 | A1 | 9/2002 | Hammersmith et al. | |
| 2003/0089377 | A1 | 5/2003 | Hajaligol et al. | |
| 2003/0164173 | A1* | 9/2003 | Zawadzki | A24D 1/025 131/365 |
| 2004/0221861 | A1 | 4/2004 | Eibl | |
| 2005/0016556 | A1* | 1/2005 | Ashcraft | A24D 1/025 131/365 |

FOREIGN PATENT DOCUMENTS

| | | |
|---|---|---|
| FR | 1366931 | 7/1964 |
| WO | 2002030988 | 4/2002 |
| WO | 2003034845 | 4/2002 |
| WO | 2002067704 | 9/2002 |

OTHER PUBLICATIONS

Nebergall et al., General Chemistry, Fourth Edition, 1972, pp. 242-243.

Gruber, et al. "Potenzial von gragmentierter Starke als Streichfarbenbindemittel." Wochenblatt Fur Papierfabrikation, 22 (2005).

Darmastadt 2005, Dissertation. "Fragmentierte STarken." Hydrogelartige Cobinder in Papier-Streichfarben.

English Abstract of Darmastadt 2005, Dissertation. "Fragmentierte STarken." Hydrogelartige Cobinder in Papier-Streichfarben.

Gruber et al. "Fragmentierte Starke fur die Verbesserung der opischen und mechanischen Eigenschaften von Papieren mit niedrigen Flachengewichten." Technische Universitat Darmstadt.

First Office Action dated Mar. 17, 2011 in the inter partes reexamination of U.S. Pat. No. 6,725,867.

* cited by examiner

*Primary Examiner* — Michael J Felton

*Assistant Examiner* — Phu Nguyen

(74) *Attorney, Agent, or Firm* — Rudolf E. Hutz; Reed Smith LLP

(57) ABSTRACT

Disclosed is a smoking article wrapping material comprising a base wrapping material to which has been applied, at least in discrete zones, a composition comprising a mechanically fragmented, chemically crosslinked polysaccharide having a particle size (weighted average) in the range from 1 to 1000 μm for the dry product; a process for production thereof; and a smoking article comprising the smoking article wrapping material described.

12 Claims, No Drawings

SMOKING PRODUCT WRAPPING MATERIAL HAVING IMPROVED SMOULDERING PROPERTIES

RELATED APPLICATIONS

This application is a division of U.S. application Ser. No. 13/079,617 filed Apr. 4, 2011, which is a continuation of U.S. application Ser. No. 12/083,314 filed Apr. 9, 2008, now abandoned which is a United States national stage of International Application No. PCT/EP2005/055198, filed Oct. 12, 2005, which was published as International Publication No. WO 2007/042077, the entire contents of which are hereby expressly incorporated herein by reference thereto.

The present invention relates to an improved smoking article wrapping material which endows smoking articles, for example cigarettes, with controlled freeburn properties, so that on the one hand the smoking article will burn unhinderedly when held in a freeburn state in which the burning product is sufficiently exposed to the air on all of its sides, and on the other will self-extinguish upon contacting substrates which can themselves be combustible.

It is known in the pertinent field to apply substances such as polymers, silicates, polysaccharides and derivatives in aqueous and nonaqueous solutions in sufficient amount and in a suitable geometric distribution to a smoking article base wrapping paper, preferably cigarette paper, in order thereby to influence the burning properties of the smoking article wrapping material.

WO-A-03/034845 describes cigarettes having an enhanced propensity to self-extinguish, the cigarette paper having annular zones whose porosity is reduced by the presence of a polymer. The polymers used comprise in particular polyvinyl acetate, partially hydrolysed polyvinyl acetate or polyvinyl alcohol.

U.S. patent application No. 20020129824 discloses a cigarette paper for making low ignition propensity cigarettes comprising a base paper with a plurality of zones of thermoplastic polymer printed on a surface of the paper wherein the plurality of zones of the base paper have Coresta porosities between 0 and 14.9 CU (=Coresta units, 1 CU=1 $cm^2/cm^3 \cdot cm^3$ min at 1 kPa pressure difference, in accordance with the recommended CORESTA [Cooperative Centre for Scientific Research Relative to Tobacco, Paris, France] test method No. 40: Determination of Air Permeability of Materials used as Cigarette Paper, Filter Plug Wrap and Filter Joining Paper including Materials Having an oriented Permeable Zone, October 1994, published in Bulletin 1994-3/4). The thermoplastic polymers used in the patent application comprise hydroxypropylcellulose, ethylcellulose, ethylhydroxyethylcellulose, N-substituted acrylamides, poly(vinyl methyl ether), poly(ethylene oxide), poly (vinyl alcohol), poly(2-ethyloxazoline), methylcellulose ether, cellulose acetate, cellulose acetate phthalate and cellulose acetate butyrate.

WO-A-02/067704 discloses a smoking article wrapping material to which has been applied, in at least one zone, a composition for reducing the permeability of the base wrapping material, the composition comprising a permeability reducing substance, a burn rate retarding substance and a burn rate accelerating substance. The substance reducing the permeability of the base wrapping material is selected in particular from polysaccharides, such as starch, modified starch, starch derivatives, cellulose, cellulose derivatives, chitosan, chitosan derivatives, chitin, chitin derivatives, alginate, alginate derivatives and combinations thereof.

From experience, the porosity of smoking article wrapping paper without zones or in sections where no porosity altering zones have been applied is in a range from 20 to 200 CU, whereas it is typically very low in the applied zones, typically being between 3 and 15 CU depending on the construction of the cigarette. The differences in porosity in the applied zones on the one hand and the base cigarette paper on the other alter the amount and composition of the smoke ingredients compared with a cigarette paper with undiminished porosity, but that must be considered undesirable in the pertinent art. Therefore, cigarette paper having porosities in the zones which are above the previously known level is of particular interest, since in this case the amount and composition of the smoke ingredients would experience a smaller change.

It is an object of the present invention to overcome the above-described problems and to provide a smoking article wrapping material having specifically altered freeburn properties.

The inventors of the present invention have found that, surprisingly, this object is achieved by a smoking article wrapping material comprising a base wrapping material to which has been applied, at least in discrete zones, a composition comprising a mechanically fragmented, chemically crosslinked polysaccharide having a particle size (weighted average) in the range from 1 to 1000 μm for the dry product.

As mechanically fragmented, chemically crosslinked polysaccharide there may be used according to the present invention a mechanically fragmented and chemically crosslinked starch, modified starch, starch derivative, cellulose, cellulose derivative, chitosan, chitosan derivative, chitin, chitin derivative, alginate, alginate derivative or a combination thereof, preferably a mechanically fragmented, chemically crosslinked starch.

A mechanically fragmented, chemically crosslinked polysaccharide is a polysaccharide which is comminuted by a shearing action and subsequent expansion using an extruder for example, which polysaccharide may also be subjected to a wide variety of chemical reactions such as for example an oxidation or reduction.

When a starch is used, the granular initial starch used can be for example a natural starch or an oxidatively, thermally or hydrolytically degraded starch or a chemically modified ether and ester derivative thereof.

Ionized polysaccharide derivatives can be produced for example using the following cationizing or anionizing agents in the degree of substitution (DS) range between 0.02-0.1: 3-chloro-2-hydroxypropyltrimethylammonium chloride, 2,3-epoxypropyltrimethylammonium chloride, 3-chloro-2-hydroxypropyldimethyldodecylammonium chloride, 3-chloro-2-hydroxypropyldimethyloctadecyl-ammonium chloride, sodium monochloroacetate, acetic anhydride and/or maleic anhydride.

For crosslinking, it is preferable to react 0.1%-0.8% by weight of a bifunctional or polyfunctional agent, reckoned on the basis of the weight of the polysaccharide in granule form, that is capable of reacting with at least two free hydroxyl groups of the polysaccharide molecules, with the starch granules. The bifunctional or polyfunctional agent which can be used is selected according to the present invention from the group consisting of aliphatic epoxy halogen or dihalogen compounds, phosphoroyl halides, alkali metal metaphosphates, aldehydes, including aldehydic resins, acid anhydrides and polyfunctional reagents such as cyanuric chloride for example.

Chemical modifying reactions can be carried out not only before extrusion but also within the extruder. It can be sensible to carry it out before extrusion, since in that case fragmentation in the extruder and subsequent dispersion of the ground product in water produces dispersions having smaller fragments.

The starches may preferably stem from tuber and root starches and also cereal starches as a starting material. Typical tuber and root starches are potato starch and tapioca starch; and readily available cereal starches are maize starch or wheat starch. However, useful starch is in no way restricted to these starches in that the only advantage of the aforementioned ones is that they are currently easy to acquire on the market. It is also possible to use mixtures of one or more starches selected from the group consisting of natural, oxidatively, thermally or hydrolytically degraded and also chemically modified tuber, root or cereal starches. Tuber, root or cereal flours can also be used as a raw material.

An extruder (not only a single-screw extruder but also a twin-screw extruder) can be used to achieve a defined fragmentation proceeding from potato starch granules for example, grinding the final dry product below 2 mm granule size, preferably below 1 mm, to an average particle size of about 500 μm.

The mechanical and thermal comminution of the crosslinked polysaccharide granules leads to fragments whose surface does not consist of ordered molecular districts, but is formed by loose, partially hydrolysed polysaccharide strands. This layer, which is "soft" after swelling in water, permits larger areas of contact with fibres and hence firmer bonding of the polysaccharide particles to fibres.

According to the present invention, the composition to be applied to the base wrapping material may optionally comprise a solvent as well as the mechanically fragmented, chemically crosslinked polysaccharide.

According to the present invention, the solvent can be water and/or an organic solvent. Useful organic solvents include for example isopropanol, ethanol, dimethylacetamide, N-methylpyrrolidone and/or N-methyl-morpholine N-oxide.

The composition to be applied to the base wrapping material may optionally further comprise a filler, a burn rate retarding substance and/or a burn rate accelerating substance.

According to the present invention, a useful filler can be selected from calcium carbonate, kaolin, titanium dioxide, talcum and magnesium oxide.

According to the present invention, disodium hydrogenphosphate is a useful burn rate retarding substance.

According to the present invention, useful burn rate accelerating substances include alkali metal or alkaline earth metal salts, such as sodium, potassium and magnesium salts, or carboxylic acid salts, such as acetic acid salts, citric acid salts, malic acid salts, lactic acid salts and tartaric acid salts, in particular citric acid salts.

The composition, in addition to the mechanically fragmented, chemically crosslinked polysaccharides to be used according to the present invention, may further comprise another base wrapping material porosity altering substance. Particularly polysaccharides which have not been subjected to mechanical fragmentation and chemical crosslinking, such as starch, modified starch, starch derivatives, cellulose, cellulose derivatives, chitosan, chitosan derivatives, chitin, chitin derivatives, alginate, alginate derivatives or a combination thereof, are suitable here.

It is to be noted that the abovementioned optional additives to the composition to be applied to the base smoking article wrapping material (filler, solvent, burn rate retarding and/or burn rate accelerating substance) are optional.

The proportions of the respective constituents in the composition to be applied to the base smoking article wrapping material, in each case based on the solids content of the composition, are typically 20-100%, preferably 45-100%, specifically 70-100% of chemically crosslinked, mechanically fragmented polysaccharide, in particular starch, if appropriate 0% to 40%, preferably 0% to 20% of a conventionally used polysaccharide, if appropriate 0-50%, preferably 0-30% of filler, and optionally 0-6% and preferably 0-3% of burn rate retarding and/or accelerating substance.

The base wrapping material to be used according to the present invention consists typically of cellulose fibres obtained from flax, soft wood or hard wood for example. To alter the properties of the base wrapping material if desired, various mixtures of cellulose fibres can be used as base wrapping material. The base wrapping material typically further comprises filler and burn rate promoting or accelerating substances.

The basis weight of the smoking article wrapping material used according to the present invention is typically in the range from 15 to 60 $g/m^2$ and preferably in the range from 18 to 40 $g/m^2$.

The present invention further provides a process for producing a smoking article wrapping material as recited above, the process comprising applying a composition comprising a mechanically fragmented, chemically crosslinked polysaccharide having a particle size (weighted average) in the range from 1 to 1000 μm for the dry product to at least discrete zones of a base smoking article wrapping material.

The applying of the composition to the base smoking article wrapping material is effected for example according to the present invention, typically after the production of the base smoking article wrapping material, using a spraying or printing technique, preferably a gravure printing technique.

These processes are well known to a person skilled in the pertinent art and exhaustively described in the patent literature, so that a detailed description of useful methods of application is not needed here.

In a further, particularly preferred embodiment of the present invention, the applying of the composition to the base smoking article wrapping material can also be effected by means of a pressure nozzle having an exit slot generally transverse to the machine direction. The pressure nozzle useful according to the present invention typically comprises a nozzle having an inner chamber under an admission pressure, controlled and fast-reacting valves to control the outflow into a nozzle slot, and a nozzle/exit slot geometry adapted to the desired application.

The use of such a pressure nozzle permits either a continuous or a discontinuous application of material to the base smoking article wrapping material in the discrete regions required for the use described. It is also possible for a plurality of separately controllable individual nozzles to be combined in modular form for the desired application.

The process, given adequate viscosity for the application medium, provides uniform coatings having clear and accurately demarcated front and back edges. Since it is not a spraying process, there are no unwanted individual splashes of the applied material outside the discrete region.

According to the present invention, the applying in accordance with one of the above-described methods of application to the base smoking article wrapping material of the composition to be applied is effected at least in discrete zones of the base smoking article wrapping material, if desired also to the entire base smoking article wrapping material.

The amount of composition applied to the base smoking article wrapping material is typically in the range of 0.1-10 $g/m^2$ and preferably 0.3-2 $g/m^2$ of the base smoking article wrapping material.

The applying is typically carried out such that application is scarcely visible, if at all, on the smoking article wrapping material obtained and the treated zones have a smooth and flat consistency which is substantially equal to that of the untreated zones.

The width and spacing of the applied zones depends on a series of variables, such as the porosity of the base smoking article wrapping material, the density of the composition of the tobacco rod, etc. The zones are typically at least 3 mm and preferably 5 to 10 mm in width.

The distance between the zones also depends on a series of variables. The zones should typically be spaced 1 to 30 mm and preferably 10 to 25 mm apart.

Usually, the smoking article wrapping paper contains (in its rolled form) 1 to 3 treated annular zones which are spaced apart as recited above.

In general, the smoking article wrapping material has a reduced porosity in the region of these zones, so that the cigarette self-extinguishes in this region if free air access is impaired. To measure the propensity to self-extinguish, the present invention employs a generally recognized standard, the NIST test as per NIST Technical Note 1436. The present invention further employs a freeburn test customary in the general field, whereby a cigarette secured in a holder is ignited once with air being freely accessible. In a successful test for freeburn, the cigarette burns down completely, without extinguishing, after it has been lit in the holder. If this is not the case and the cigarette extinguishes before it has burned down completely, this test has not been passed or been passed only in part.

Using the smoking article wrapping material claimed according to the present invention causes the smoking article to burn down unhinderedly when air is freely accessible, but to self-extinguish on substrates which may themselves be combustible. This makes it possible to reduce the propensity for smoking articles to cause fires provided the smoking article wrapping material is used as a wrapping for self-extinguishing smoking articles and the smoking article comes into contact in the burning state with combustible substrates such as textiles (carpet, upholstered furniture).

The present invention further provides a smoking article comprising a tobacco rod, a smoking article wrapping material comprising a base wrapping material to which has been applied, at least in discrete zones, a composition comprising a mechanically fragmented, chemically crosslinked polysaccharide having a particle size (weighted average) in the range from 1 to 1000 μm for the dry product, and a phyllosilicate, and if appropriate a filter.

EXAMPLES

Example 1

Test cigarettes were produced. To this end, discrete bands 7 mm wide were gravure printed onto Cigla 55 standard cigarette paper capable of glowing combustion (porosity 55 CU, Julius Glatz GmbH, Neidenfels) 18 mm apart. The printing medium used was a 13.5% aqueous suspension of a chemically crosslinked and mechanically fragmented potato starch (F6493, Emsland-Stärke GmbH, Emlichheim). Porosity in the coated regions is 14 CU.

NIST test and freeburn test are passed 100%.

Comparative Example 1

The test cigarettes were produced similarly to Example 1 except that the printing medium used was a 7.5% aqueous solution of an extremely film-formation capable potato starch hydroxypropyl ether (Emsize E2, Emsland-Starke GmbH). Porosity in the coated regions is 14 CU, the freeburn test is passed 100%, but the NIST test only 63%.

Example 2

The test cigarettes were produced similarly to Example 1, except that the printing medium used was a 12.5% suspension of the chemically crosslinked and fragmented potato starch of Example 1 (F6493). Porosity within the coated regions is 25 CU, the NIST test and the freeburn test are passed 100%.

Comparative Example 2

The test cigarettes were produced similarly to Example 1, except that the printing medium used was an 8% suspension of potato starch hydroxypropyl ether (Emsol K 115, Emsland-Starke GmbH, Emlichheim) in water. Porosity is 37 CU, freeburn is passed, the NIST test was not passed.

The invention claimed is:

1. A process for the production of smoking article wrapping materials, comprising applying a composition to at least discrete zones of a base smoking article wrapping material, said composition comprising a chemically crosslinked, mechanically fragmented starch having a particle size (weighted average) in a range of from 1 to 1000 μm of dry product, wherein the chemically crosslinked, mechanically fragmented starch is fragmented by extrusion, said extrusion comminuting the starch through a shearing action, the surfaces of the resulting fragmented starch comprising loose, partially hydrolyzed polysaccharide strands and wherein the chemical crosslinking occurs by reaction of the starch with 0.1% to 0.8% by weight of a bifunctional or polyfunctional crosslinking agent capable of reacting with at least two free hydroxyl groups of the starch.

2. The process according to claim 1 wherein the composition consists essentially of the chemically crosslinked, mechanically fragmented starch, a burn rate retarding substance and/or a burn rate accelerating substance.

3. The process according to claim 1, wherein the composition consists essentially of the chemically cross-linked, mechanically fragmented starch.

4. The process according to claim 1, wherein the composition further comprises a filler, a burn rate retarding substance, a burn rate accelerating substance or mixtures thereof.

5. The process according to claim 1, wherein the applying is effected by printing or spraying.

6. The process according to claim 1, wherein the applying is effected using a pressure nozzle.

7. The process according to claim 1, wherein the composition further comprises water, a mixture of water and organic solvent, an organic solvent, or a mixture of organic solvents.

8. The process according to claim 1, wherein the applying is by gravure printing.

9. The process according to claim 1, wherein the amount of composition applied to the base smoking article wrapper material is in a range of 0.1 to 10 $g/m^2$ of the base smoking article wrapping material.

10. The process according to claim 1, wherein the distance between discrete zones is around 1 to 30 mm.

11. The process according to claim 10, wherein the discrete zones have a width of 5 to 10 mm.

12. The process according to claim 1, wherein the discrete zones have a width of at least 3 mm.

* * * * *